US007789081B2

(12) United States Patent
Raby et al.

(10) Patent No.: US 7,789,081 B2
(45) Date of Patent: Sep. 7, 2010

(54) MODULAR FRAME CHASSIS FOR COOKING RANGE

(75) Inventors: Rejean Raymond Raby, Stevensville, MI (US); Louis Scott Smith, South Bend, IN (US); David Stewart Thomas, Stevensville, MI (US); Abu Noman Hossain, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1036 days.

(21) Appl. No.: 11/407,790

(22) Filed: Apr. 20, 2006

(65) Prior Publication Data

US 2007/0246038 A1 Oct. 25, 2007

(51) Int. Cl.
*F24C 5/00* (2006.01)

(52) U.S. Cl. ..... 126/273 R; 126/50

(58) Field of Classification Search ..... 126/273 R, 126/19 R, 50, 41 R, 39 R
See application file for complete search history.

(56) References Cited

U.S. PATENT DOCUMENTS

| | | | | |
|---|---|---|---|---|
| 2,150,300 | A | 3/1939 | Teller et al. | |
| 4,245,615 | A | 1/1981 | Moss | |
| 6,089,393 | A | 7/2000 | Revelli et al. | |
| 6,152,553 | A | 11/2000 | Wunderlich | |
| 2003/0227240 | A1 | 12/2003 | Khosropour et al. | |
| 2003/0230299 | A1 * | 12/2003 | Bruno et al. | 126/25 R |
| 2004/0145283 | A1 | 7/2004 | Saravis | |

* cited by examiner

*Primary Examiner*—Alfred Basichas
(74) *Attorney, Agent, or Firm*—John W. Morrison; Tara M. Hartman; McGarry Bair PC

(57) ABSTRACT

A household cooking range comprises a housing defining a cooking cavity, the housing being selected from one of multiple housings with different configurations, and a modular frame chassis supporting the selected housing and cooking cavity.

9 Claims, 7 Drawing Sheets

MODULAR FRAME CHASSIS FOR COOKING RANGE

BACKGROUND OF THE INVENTION

1. Field of the Invention

The invention relates generally to household cooking ranges, and specifically to a modular frame chassis for supporting an assemblage of elements comprising a household cooking range.

2. Description of the Related Art

Conventional household cooking ranges typically have a "uni-body" construction in which the load-carrying, structural aspects are provided by the same elements that provide the architectural or aesthetic features of the range. An example of such a prior art construction is illustrated in FIG. 1 in which the principal structural components of a cooking range 10 are illustrated. The cooking range 10 comprises a housing 12 assembled from a front panel 14, a rear panel 16, and a pair of side panels 18, 20. A pair of base rails 22, 24 extend between the front and rear panels 14, 16 and mount a plurality of foot assemblies 26 that support the housing 12 relative to the floor. A cooktop panel 28 for use with a plurality of conventional burners (not shown) is attached to the top of the housing 12. An oven housing 32 defining a cooking chamber 34 is sandwiched between and supported by the front panel 14 and rear panel 16.

The front panel 14, rear panel 16, and side panels 18, 20 are typically large, planar elements, and must not only serve as an aesthetically pleasing enclosure, but must also provide structural support for the oven housing 32, the cooktop panel 28, the burners, a control panel, a drawer, and other such elements typically found in a conventional household cooking range. In order to provide the structural capability necessary to satisfactorily support these items, the front panel 14, rear panel 16, and side panels 18, 20 must be specially fabricated with reinforcing elements, such as bends, ribs, reinforcers, offsets, and the like. Such elements can be separately fabricated and attached, such as by welding, to the panel. Alternatively, the panel can be fabricated with these elements integrated into the panel by a stamping and rolling process utilizing specialized tooling, such as dies, cutting tools, and the like. A complete set of tooling must be provided for each panel comprising a cooking range configuration.

Additionally, panels that contain openings, such as gas or electric supply line openings, oven door openings 36, drawer openings 38, and the like, must be provided with structural reinforcing at and around such openings. This reinforcing also requires specialized tooling, and may even necessitate additional fabrication steps.

Reinforcing elements, whether separately fabricated and attached to the frame, or integrated into the frame, and the assembly of the frames into a housing, add considerable cost to the finished product. In particular, dies, cutting tools, and the like are frequently very expensive to manufacture and maintain, and the need for multiple sets of tooling for different cooking range frame configurations can be extremely costly.

There is a need for a household cooking range construction comprising interchangeable modular structural elements which can be readily modified to accommodate cooktop ranges of varying configurations and features.

SUMMARY OF THE INVENTION

A household cooking range comprises a housing defining a cooking cavity, the housing being selected from one of multiple housings with different configurations, and a modular frame chassis supporting the selected housing and cooking cavity. The modular frame chassis comprises front and rear main brackets, a side bracket connecting the front and rear main brackets, and a width bracket mounted to at least one of the main brackets, wherein the side bracket and width bracket are sized and mounted to the main brackets to support the housing at a selected one of a plurality of predetermined positions relative to the main brackets.

A method of assembling a household cooking range comprises selecting a housing defining a cooking cavity from a plurality of housings having different configurations, selecting a pair of main brackets, selecting side and width brackets, and assembling the selected main, side, and width brackets to mount the selected housing to the main brackets at a selected one of a plurality of predetermined positions relative to the main brackets.

DESCRIPTION OF AN EMBODIMENT OF THE INVENTION

Figure 1:
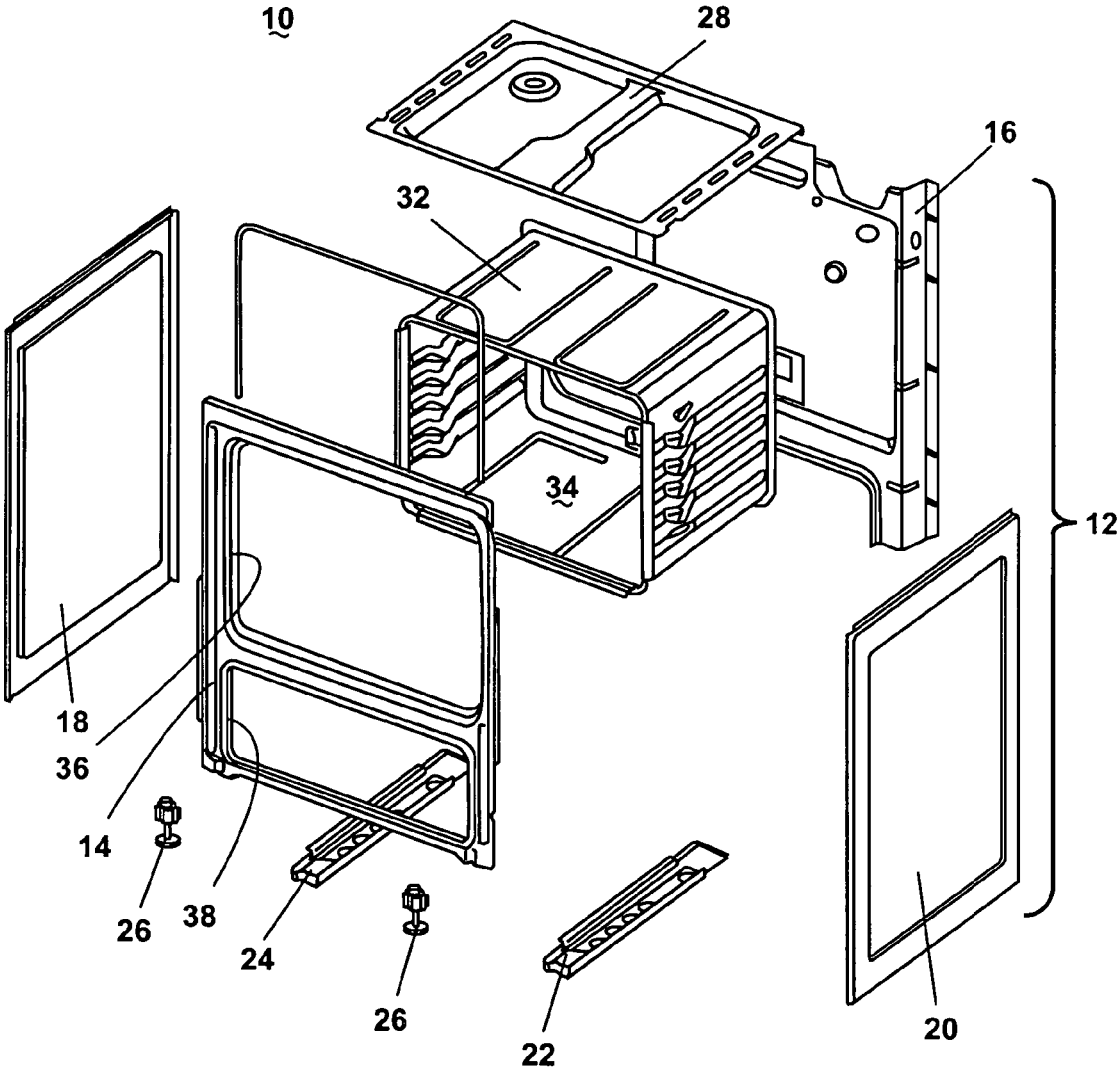
Fig. 1 (PRIOR ART)
FIG. 1 is an exploded view of a portion of a prior art household cooking range.
Figure 2:
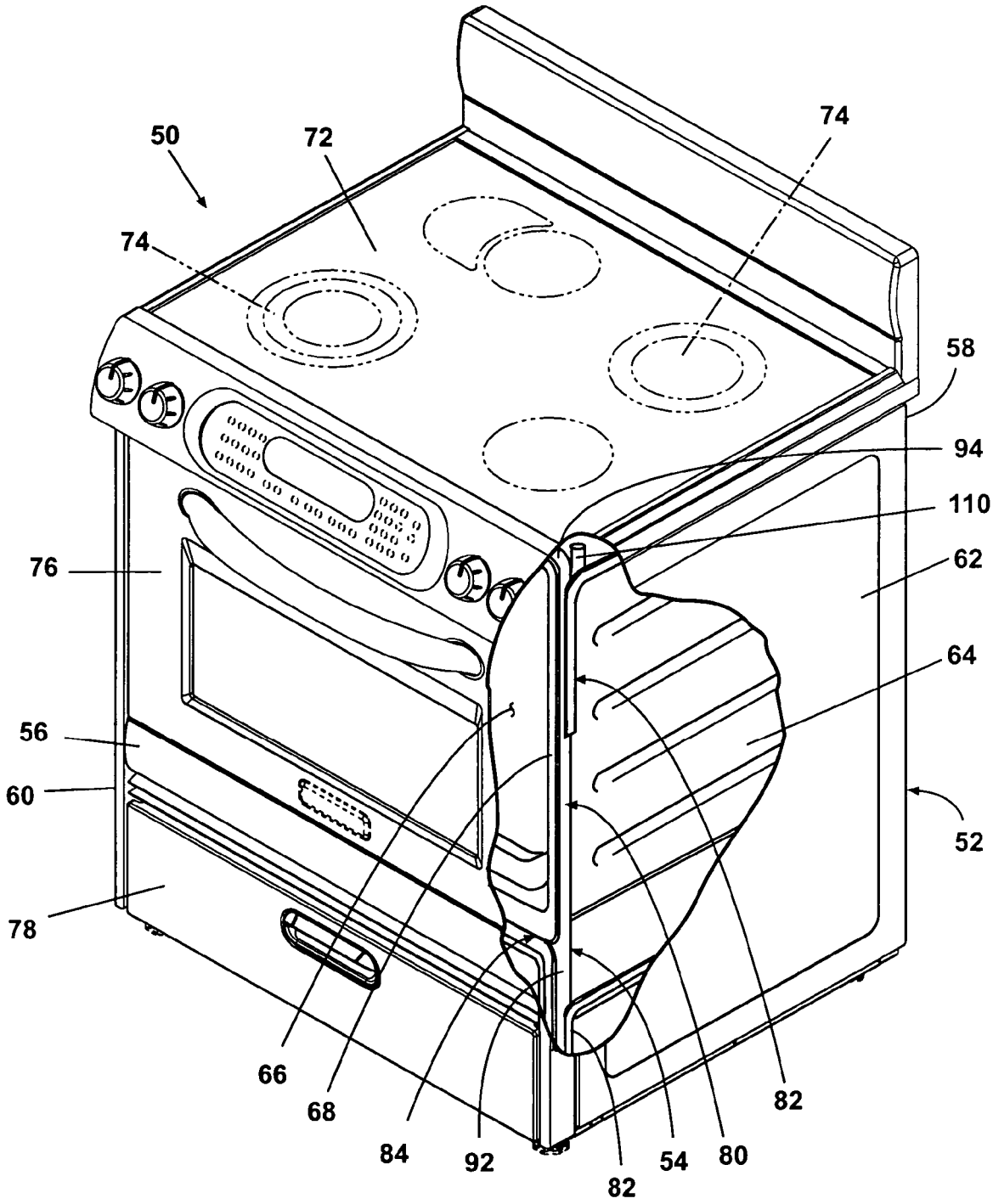
FIG. 2 is a perspective view of a household cooking range comprising a modular frame chassis according to the invention comprising an assemblage of brackets.
Figure 3:
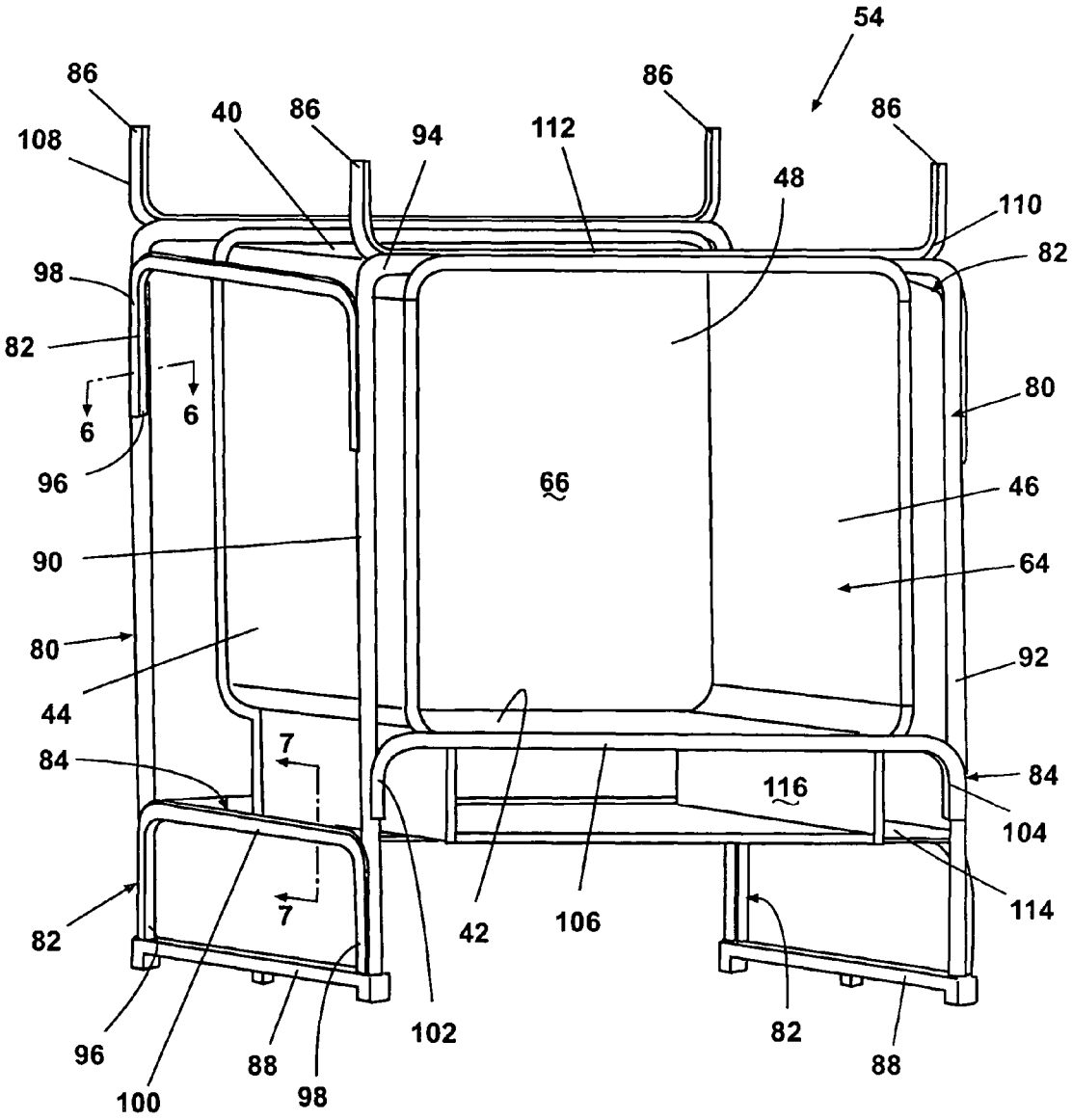
FIG. 3 is a perspective view of the modular frame chassis illustrated in FIG. 2 with portions removed for clarity, and illustrating the modular frame chassis supporting an oven housing.

Referring now to FIGS. 2 and 3, a household cooking range 50 is illustrated comprising an external housing 52 overlying a modular frame chassis 54 according to the invention. The housing 52 comprises a front panel 56, a rear panel 58, and a pair of side panels 60, 62. The housing 52 encloses an oven housing 64 adapted for heating and cooking food items utilizing either gas or electric heat provided by a suitable heating apparatus enclosed in a heater chamber 116. The oven housing 64 comprises a top wall 40, a bottom wall 42, side walls 44, 46, and a back wall 48 which collectively define a cooking chamber 66 into which a food item to be cooked is placed. The cooking chamber 66 is provided with a plurality of racks (not shown) for supporting food items during cooking. The range 50 is also provided with a cooktop panel 72 containing a plurality of burner assemblies 74. The cooking chamber 66 is closed with a hinged oven door 76. The front panel 56 can be provided with an additional opening (not shown) for a pullout storage drawer 78 located beneath the oven housing 64, an auxiliary oven (not shown), and the like. While not shown, a warming drawer or storage drawer can be located beneath the oven housing.

Figure 4:
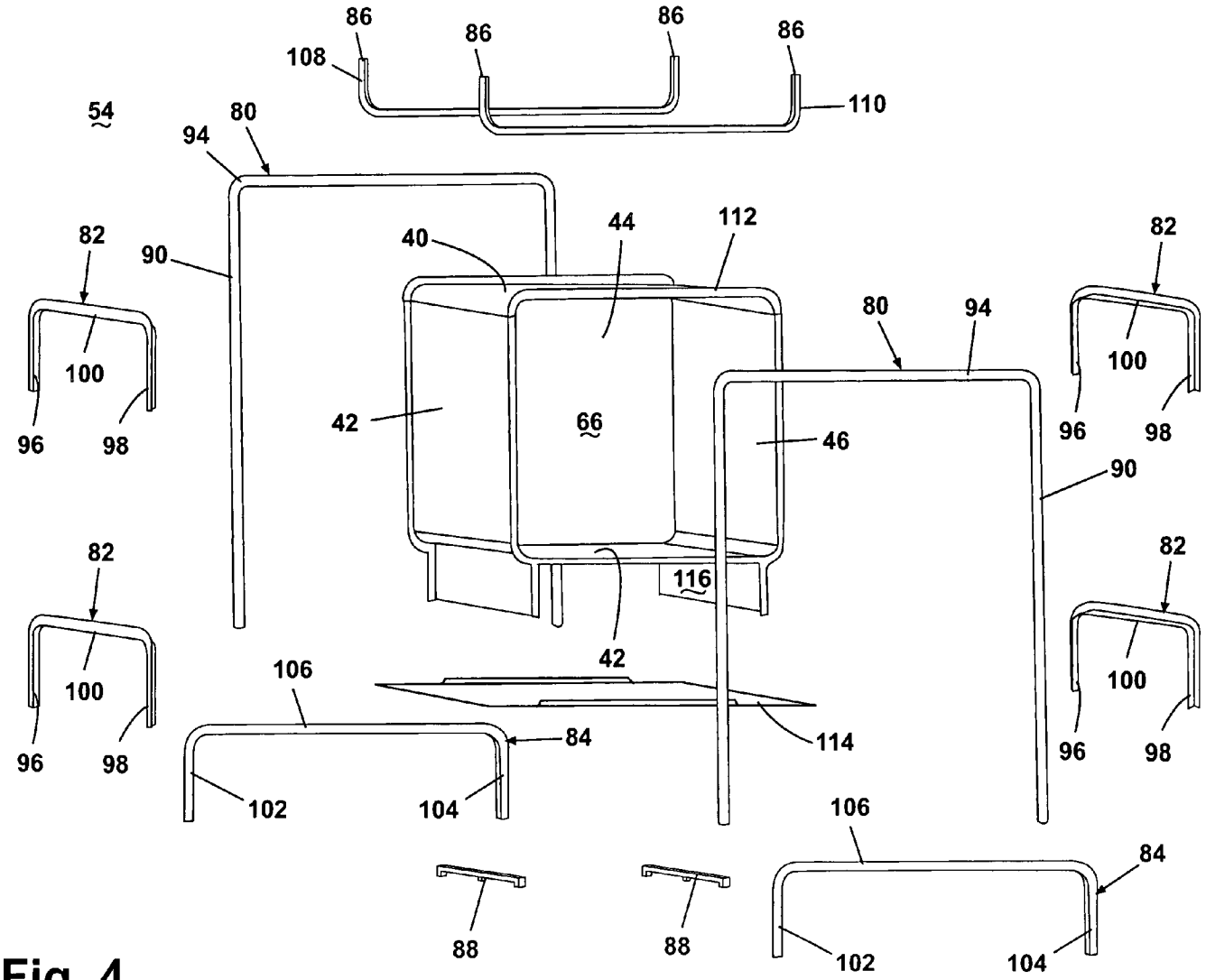
FIG. 4 is an exploded view of the modular frame chassis illustrated in FIG. 3.

Referring now to FIGS. 3 and 4, the modular frame chassis 54 comprises an assembly of main brackets 80, side brackets 82, and width brackets 84 to form a generally rectilinear structure for supporting the oven housing 64. The modular frame chassis 54 incorporates a beam-column load bearing concept for supporting the operational components of the cooking range 50, e.g. the cooking chamber 66, storage drawer 78, range top, and the like.

The main brackets 80 are generally U-shaped members comprising a pair of parallel, spaced-apart main bracket legs 90, 92 integrally joined by a main bracket crosspiece 94. The length of the main bracket crosspiece 94 is selected so that the main brackets 80 have a width correlative with the width of the oven housing 64.

The side brackets 82 are generally U-shaped members comprising a pair of parallel, spaced-apart side bracket legs 96, 98 integrally joined by a side bracket crosspiece 100. The length of the side bracket crosspiece 100 is selected to correlate approximately with the depth of the oven housing 64, and will typically be somewhat greater than the oven housing depth.

The width brackets 84 are generally U-shaped members comprising a pair of parallel, spaced-apart width bracket legs 102, 104 integrally joined by a width bracket crosspiece 106. The length of the width bracket crosspiece 106 is approximately equal to the length of the main bracket crosspiece 94.

Figure 5:
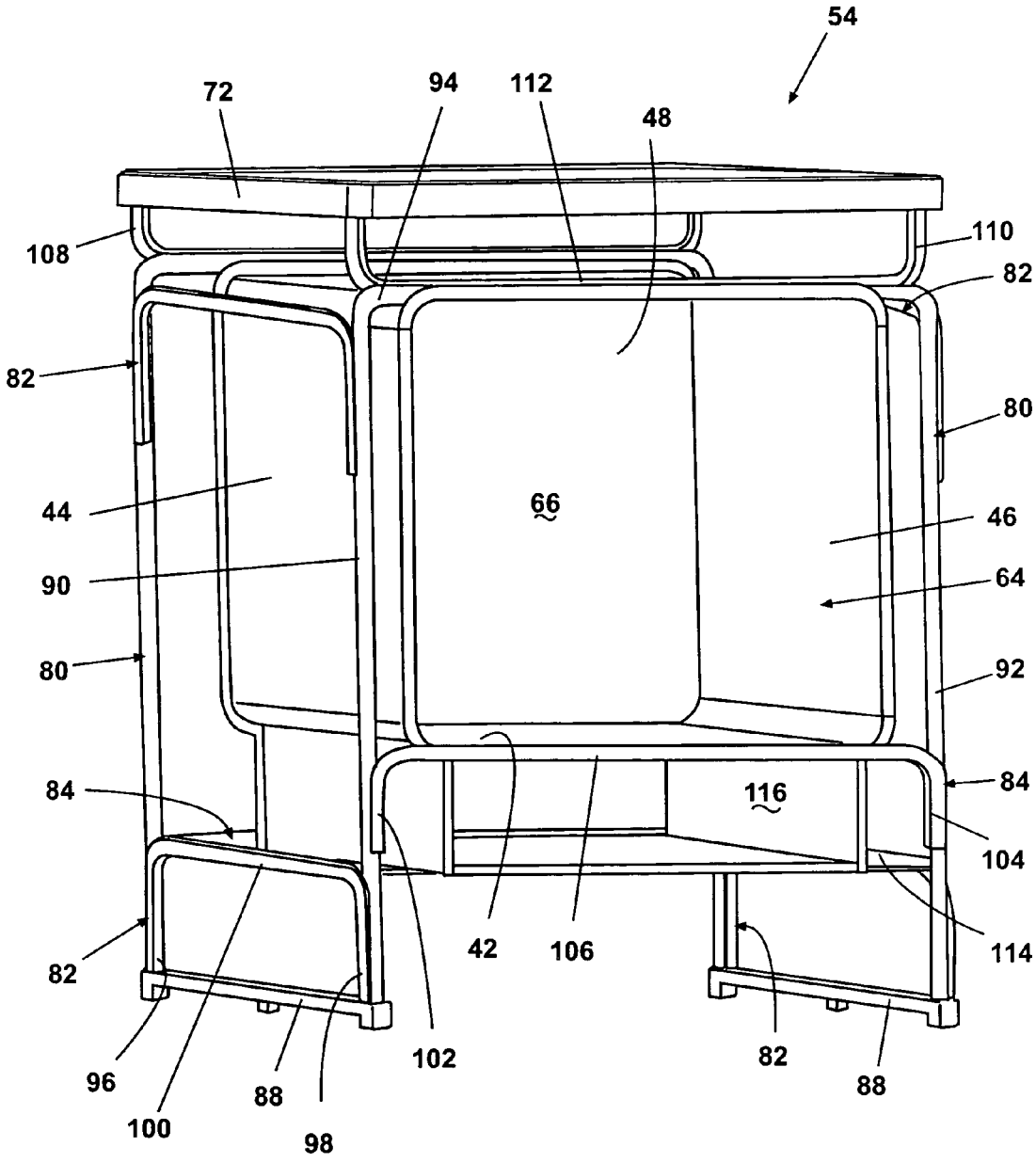
FIG. 5 is a perspective view of the modular frame chassis illustrated in FIG. 3 with portions removed for clarity, and illustrating the modular frame chassis supporting an oven housing and a cooktop panel.

The modular frame chassis 54 can also be provided with a pair of cooktop brackets 86 for attaching a cooktop panel 72 to the modular frame chassis 54, as illustrated in FIG. 5. The cooktop brackets 86 are generally U-shaped members comprising a pair of parallel, spaced-apart cooktop bracket legs 108, 110 integrally joined by a cooktop bracket crosspiece 112. The length of the cooktop bracket crosspiece 112 is approximately equal to the length of the main bracket crosspiece 94.

The main brackets 80, side brackets 82, width brackets 84, and cooktop brackets 86 are fabricated of a material having a suitable strength and durability for the purposes described herein, such as steel angle members, which are bent into a preselected size and configuration.

Figure 6:
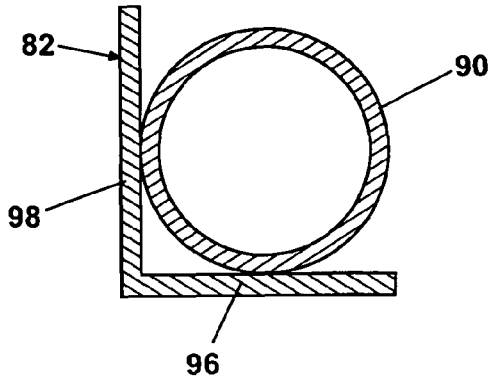
FIG. 6 is a sectional view taken along view line 6-6 of FIG. 3.

As illustrated, the modular frame chassis 54 is assembled with a first main bracket 80 and a second main bracket 80 juxtaposed for support of a preselected oven housing 64 therebetween. A plurality of side brackets 82, illustrated in FIG. 3 as number 4, are rigidly attached to the first and second main brackets 80 through suitable means, such as welding, self tapping screws, bolted connections, rivets, and the like, to form a generally rectilinear chassis 54. Referring also to FIG. 6, the side brackets 82 are in registry with the main bracket legs 90, 92 so that the side bracket legs 96, 98 extend downwardly and the main bracket legs 90, 92 are cradled along the side bracket legs 96, 98.

Figure 7:
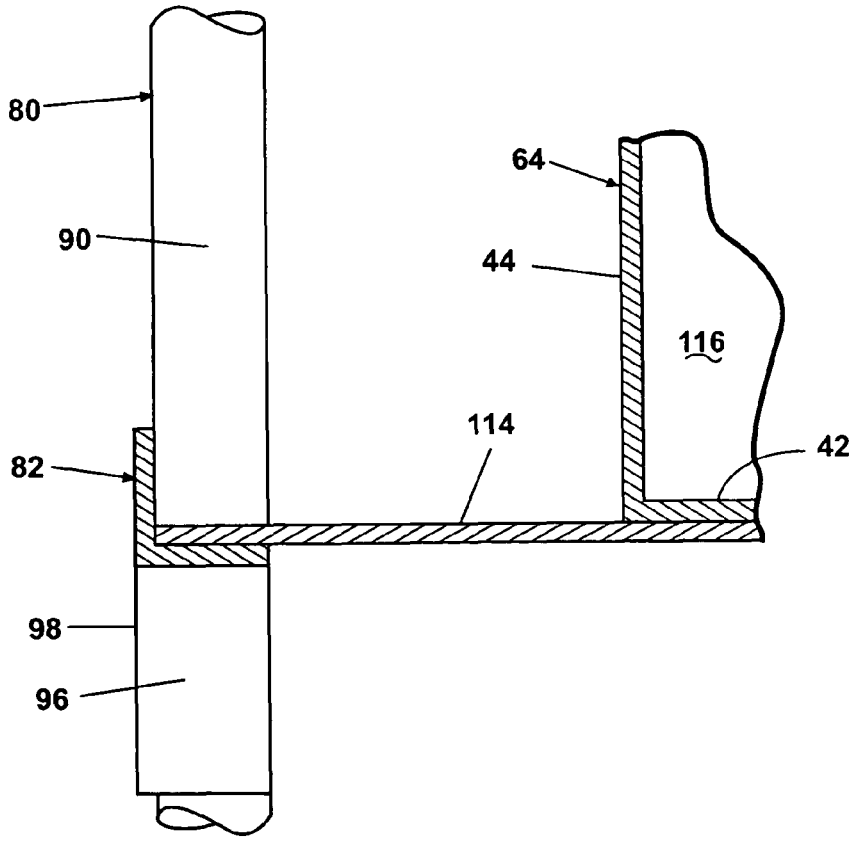
FIG. 7 is a sectional view taken along view line 7-7 of FIG. 3.

Referring to FIG. 7, a support panel 114 can be supported on the side bracket crosspieces 100 to extend across the width of the main brackets 80 for support of the bottom wall 42 of the oven housing 64. Alternatively, the oven housing 64 can be attached directly to the assembled modular frame chassis 54 by welding, self tapping screws, bolted connections, rivets, and the like. The main brackets 80 serve as anchor members that enable the modular frame chassis 54 to be securely attached to cabinetry, walls, or other modular frame chassis. The side brackets 82 and width brackets 84 serve as beams for attachment of components such as the cooking chamber 66, storage drawer 78, range top, and the like, and for optimizing load distribution throughout the chassis. Greater or fewer numbers of side brackets and width brackets can be employed as necessary to achieve these objectives.

Similarly, a plurality of width brackets 84 are rigidly attached to the main bracket legs 90, 92 through suitable means, such as welding, self tapping screws, bolted connections, rivets, and the like. The width brackets 84 are in registry with the main bracket legs 90, 92 so that the width bracket legs 102, 104 extend downwardly and the main bracket legs 90, 92 are cradled along the width bracket legs 102, 104. The side brackets 82 and the width brackets 84 are located vertically along the main bracket legs 90, 92 to support the oven housing 64 at a preselected height. A pair of base rails 88 can be attached to the ends of the first and second main bracket legs 90, 92 to further join the first and second main brackets 80, and provide a support structure for the attachment of foot assemblies for leveling the cooking range 50.

The cooktop brackets 86 are attached to the main bracket crosspiece 94 so that the cooktop bracket legs 108, 110 extend upwardly away from the main bracket crosspiece 94. The cooktop brackets 86 are rigidly attached to the main bracket crosspiece 94 through suitable means, such as welding, self tapping screws, bolted connections, rivets, and the like, so that the cooktop bracket crosspiece 112 cradle the main bracket crosspiece 94 along the cooktop bracket crosspiece 112. The cooktop panel 72 can then be attached in a conventional manner to the cooktop brackets 86, as illustrated in FIG. 5.

Front, rear, and side panels can then be suspended from the modular frame chassis 54, an oven door can be mounted to the width bracket crosspiece 106 extending along the front of the oven housing 64, and a control panel and a burner assemblies can be attached to the cooktop panel 72 to complete the assembly of the cooking range 50.

Ranges and ovens can be configured with different numbers of burners, e.g. 4, 6 and 8, and different cooking chamber capacities, which necessitate different sizes of cooktop panels and housings. With current unibody construction, it is costly to accommodate the many different sizes of panels and housing elements because the individual pieces are fabricated, typically by stamping.

The modular frame chassis described herein provides a structural framework for support of an oven housing, a cooktop panel, and exterior panels which utilizes simple tube and angle members that are readily available, relatively inexpensive, and easily fabricated into desired shapes. Exterior panels can be fabricated with a minimum of tooling, and readily suspended from the modular frame chassis, thereby simplifying and economizing the fabrication of the panels. Different sized cooking ranges can be readily assembled from chassis frame members that are economically bent to the proper size, eliminating the need for a multiplicity of costly structural frame panels. The modular frame chassis thus provides much greater size and configuration flexibility at a lower cost. In addition to more readily accommodating cooking chambers and cooktops of different sizes, the modular frame chassis can accommodate different cooking chamber locations within the space defined by the frame. The modular chassis has the adaptability of accommodating many elements having various sizes and configurations to accommodate a variety of consumer needs. The principal elements of a cooking range are the oven housing, the cooktop, the cooktop gas burner manifold, the warm drawer/storage drawer/triple task drawer, and the oven heater chamber. The modular chassis enables each of these elements to be readily configured in different sizes, and selectively combined in different configurations to produce cooking ranges having a wide variation in sizes and features.

Figure 8:
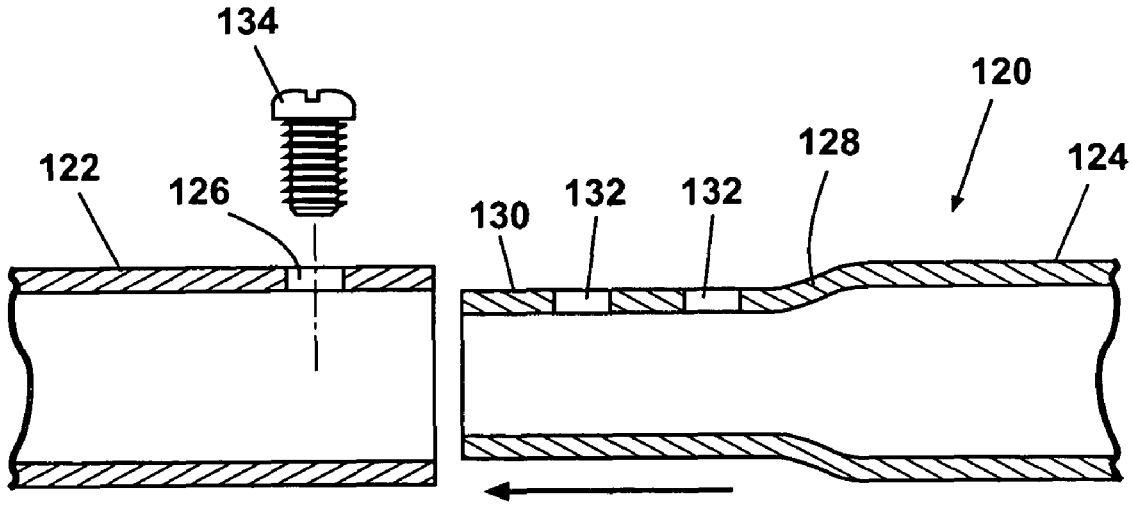
FIG. 8 is an exemplary sectional view of a portion of a modular frame chassis illustrating an alternative embodiment of a bracket.

FIG. 8 illustrates an alternative main bracket 120 which provides additional modularity and flexibility in configuring cooking ranges of differing sizes. The brackets described above comprise single members, which must be fabricated in various sizes to enable cooking ranges of differing dimensions to be assembled. The main bracket 120 is identical to the main bracket 80 except that the main bracket crosspiece 94 is divided at approximately its midsection into a female crosspiece member 122 and a male crosspiece member 124. The female crosspiece member 122 is provided near its terminus with an aperture 126 extending radially therethrough and adapted for slidable receipt of a threaded fastener 134. The male crosspiece member 124 has a diameter generally equal to the diameter of the female crosspiece member 122, and transitions near its terminus through a neck 128 to an insert portion 130 adapted for slidable registry with the female crosspiece member 122. The insert portion 130 is provided with a plurality of threaded apertures 132 adapted for receipt of the fastener 134. The insert portion 130 can be aligned in the female crosspiece member 122 with the apertures 126, 132 in coaxial alignment, and the fastener 134 can then be installed in the apertures 126, 132 to rigidly attach the female crosspiece member 122 to the male crosspiece member 124 and thereby form the main bracket 120. The width of the main bracket 120 can be adjusted by selecting the aperture 132 to receive the fastener 134. The side brackets and width brackets can be similarly configured to provide 3-dimensional adjustment of the modular frame chassis for fabrication of different sized cooking ranges.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household cooking range comprising:

a modular tubular frame chassis defining a cavity comprising:

a U-shaped front tubular main member having a pair of spaced legs;

a U-shaped rear tubular main member, spaced from the front tubular member, having a pair of spaced legs;

a pair of side tubular members, one of the pair of side tubular members connecting at least one leg of each of the front and rear members along one side of the cavity, and the other of the pair of side tubular members connecting at least one leg of each of the front and rear members along an opposite side of the cavity; and a pair of width tubular members, one of the pair of width tubular members connecting the legs of the rear member along a rear of the cavity, and the other of the pair of width tubular members connecting the legs of the front member along a front of the cavity to define, in combination with the U-shaped front tubular member, a front opening to the cavity; and an oven housing received within the cavity and supported by the tubular frame chassis, and having an open face coincident with the front opening of the cavity.

2. A household cooking range in accordance with claim 1, and further comprising a cooktop member for supporting a cooktop.

3. A household cooking range in accordance with claim 2, wherein the cooktop member comprises a U-shaped member mounted to at least one of the front tubular main member and the rear tubular main member and having a pair of legs extending away from the main member.

4. A household cooking range in accordance with claim 1, and further comprising a support panel extending between the side members to support the oven housing.

5. A household cooking range in accordance with claim 1, wherein the side members have a U-shape with a pair of parallel legs attached to the main members.

6. A household cooking range in accordance with claim 1, wherein the width members have a U-shape with a pair of parallel legs attached to the main members for supporting the selected oven housing at a selected one of a plurality of predetermined positions relative to the main members.

7. A household cooking range in accordance with claim 1, wherein the front and rear main members each have one of an circular cross-section and an L-shaped cross-section.

8. A household cooking range in accordance with claim 7, wherein the side member has an L-shaped cross-section.

9. A household cooking range in accordance with claim 8, wherein the width member has an L-shaped cross-section.

* * * * *